United States Patent [19]

House

[11] Patent Number: 4,692,401

[45] Date of Patent: Sep. 8, 1987

[54] PHOTOGRAPHIC EMULSIONS AND ELEMENTS CONTAINING SENSITIZING DYE IN THE FORM OF HOST CRYSTALS

[75] Inventor: Gary L. House, Victor, N.Y.

[73] Assignee: Eastman Kodak Company, Rochester, N.Y.

[21] Appl. No.: 899,195

[22] Filed: Aug. 21, 1986

[51] Int. Cl.[4] ..... G03C 1/12; G03C 1/19; G03C 1/46

[52] U.S. Cl. ..... 430/570; 430/505; 430/567; 430/576; 430/577; 430/581

[58] Field of Search ..... 430/570, 567, 576, 577, 430/505, 581

[56] References Cited

U.S. PATENT DOCUMENTS

| | | | |
|---|---|---|---|
| 3,909,271 | 9/1975 | Ikenoue et al. | 430/570 X |
| 4,425,426 | 1/1984 | Abott et al. | 430/570 X |
| 4,442,201 | 4/1984 | Takada et al. | 430/570 X |

*Primary Examiner*—John E. Kittle
*Assistant Examiner*—Mukund J. Shah
*Attorney, Agent, or Firm*—Carl O. Thomas

[57] ABSTRACT

A photographic emulsion is disclosed containing grains comprised of a silver salt capable of forming a latent image, a sensitizing dye, and a dispersing medium. The sensitizing dye is present in the form of host crystals, and the grains are in conductive contact with the host dye crystals. A photographic element containing the emulsion is also disclosed.

12 Claims, 6 Drawing Figures

PHOTOGRAPHIC EMULSIONS AND ELEMENTS CONTAINING SENSITIZING DYE IN THE FORM OF HOST CRYSTALS

FIELD OF THE INVENTION

This invention relates to photographic emulsions and to photographic elements containing these emulsions. More specifically, this invention is directed to sensitizing dye containing photographic emulsions and elements.

PRIOR ART

It has been known for more than a hundred years that photographic emulsions can be sensitized by dye introduction. Initially the photographic plates were bathed in a dye solution before exposure. The modern approach is to adsorb a dye to the latent image forming silver salt grains of the emulsion after their formation and before coating on a support. For a summary of the early history of sensitizing dyes in photography, attention is directed to F. M. Hamer, *Cyanine Dyes and Related Compounds,* John Wiley and Sons, 1964, pp. 1 to 11. For a collection of the common sensitizing dyes used in photographic emulsions, attention is drawn to *Research Disclosure,* Vol. 176, December 1978, Item 17643, Item IV. *Research Disclosure* is published by Kenneth Mason Publications, Ltd., Emsworth, Hampshire P010 7DD, England.

It has been recognized that silver halide emulsions can be precipitated with a sensitizing dye present in solution in the reaction vessel. The following teachings are considered representative: Capstaff U.S. Pat. No. 1,991,136, Schmid U.S. Pat. No. 2,029,946, Hill U.S. Pat. No. 2,735,766, Locker U.S. Pat. No. 4,183,756, Locker et al U.S. Pat. No. 4,225,666, Ulbing U.S. Defensive Publication No. T887,029, and U.K. Pat. No. 1,027,900.

Steiger et al U.S. Pat. No. 4,040,825 teaches in column 17, lines 2 through 5, bringing a sensitizing dye covalently bound to a hydrophilic colloid into contact with single crystals or vapor-deposited layers of silver halide.

Maskasky U.S. Pat. No. 4,094,684 discloses the epitaxial growth of silver chloride grains on silver iodide host grains to form a silver halide emulsion. Absorption of photons by the silver iodide host grain in its region of native sensitivity allows a latent image to be formed in the silver chloride epitaxy. Maskasky U.S. Pat. No. 4,142,900 provides an essentially cumulative disclosure, but in this instance the silver chloride epitaxy has been converted to silver chlorobromide.

SUMMARY OF THE INVENTION

In one aspect this invention is directed to a photographic emulsion comprising grains containing a silver salt capable of forming a latent image, a sensitizing dye, and a dispersing medium. The silver salt emulsion is characterized in that the sensitizing dye is present in the form of host crystals and the grains are in conductive contact with the host dye crystals.

In another aspect this invention is directed to a photographic element containing an emulsion as described above.

The present invention offers a number of fundamental advantages over the prior state of the art. The invention offers further distinct advantages when applied to varied photographic applications.

These advantages can be better appreciated by comparing conventional photographic emulsions. Photographic emulsions commonly comprise grains of a silver salt capable of forming a latent image, such as silver halide grains, in a dispersing medium. During imagewise exposure a radiation sensitive grain typically absorbs only a fraction of the incident photons. Absorption of a photon elevates the energy level of an electron from the valence band to the conduction band. This creates a conduction band electron and a vacancy in the crystal lattice, referred to as a photogenerated hole electron pair. Both the hole and the electron are free to migrate in the grain. If the hole and electron spontaneously recombine, the photon energy is dissipated. If several conduction band electrons come into proximity, a latent image site is formed in the grain—i.e., enough silver atoms are locally created to catalyze development of the grain. In forming a latent image by this mechanism the hole serves no useful purpose. Special purpose emulsions, such as fogged direct positive emulsions, are known which use only the photogenerated hole in imaging.

It is known that the speed of a photographic emulsion can be increased by chemical sensitization—e.g., reduction sensitization, noble metal sensitization, an/or middle chalcogen sensitization. Chemical sensitization not only increases the speed of a photographic emulsion, but also increases fog. For any given photographic application there is an optimum balance of chemical sensitization and fog. Any attempt to increase the speed of an emulsion further by chemical sensitization alone results in unacceptable fog levels.

It is also known that the speed of a photographic emulsion can be increased by increasing its mean grain size. However, there is again a limit to practically realizable speed increases, since the granularity of a photographic emulsion increases with mean grain size. The chosen mean grain size for a given emulsion is then a compromise intended to achieve the highest speed consistent with image granularity requirements.

A further technique for increasing emulsion speed is to adsorb a sensitizing dye to the grain surface. While this approach is in some instances employed to increase photographic speed in the spectral region of native grain sensitivity, it is more commonly employed to impart sensitivity to a grain outside its region of native sensitivity. In either instance, adsorbed dye enhances grain response to exposing radiation by absorbing photons and transferring energy, usually in the form of an electron or a hole, to the grin. Increasing the amount of dye adsorbed increases speed up to a point, but beyond that point, which is usually something less than a monomolecular coverage of the grain surface, desensitization of the grain occurs.

In adsorbing sensitizing dye to the surface of grains it has been postulated that it is the surface area presented by the grains which determines the speed enhancement which can be realized. Unfortunately, the surface to volume ratio of grains increases with decreasing grain size. Thus, it has been generally assumed that increasing grain sizes and increasing surface to volume ratios are incompatible. Recently it has been recognized that changing the shape of grains can be usefully employed to increase their surface to volume ratios without reducing mean grain size.

Photographic emulsions having the highest speed potential are those that combine optimized chemical and spectral sensitization with high surface to volume grain configurations. Kofron et al U.S. Pat. No. 4,439,520 is illustrative and provides a background for appreciating the limits of any one approach. Solberg et al U.S. Pat. No. 4,433,048 and Maskasky U.S. Pat. No. 4,435,501 offer further speed enhancements by extending the teachings of Kofron et al to optimum halide placements in tabular silver halide grains.

The fundamental speed limitations of photographic emulsions employing sensitizing dye adsorbed to grain surfaces can be avoided by the present invention. In the present invention the host dye crystals are employed in combination with grains of a silver salt capable of forming a latent image conductively located on the host dye crystals. The host dye crystals act as the primary receptors of exposing radiation. By properly relating the conduction and valence bands of a host dye crystal and a conductively associated grain it is possible to transfer from the host dye crystal to the grain latent image forming energy. this capability reduces the possibility of recombination that occurs when a photogenerated hole electron pair are created within the grains, thereby improving the latent image forming efficiency of the grain. Additionally, since the host dye crystal can have a much higher refractive index than the surrounding dispersing medium, internal guiding of unabsorbed photons is possible. This increases the probability of retention and absorption of the photon within the dye crystal.

Since the dye crystals rather than the grains themselves are capable of acting as the primary receptors of actinic radiation, the size of the host dye crystals can control the speed of the emulsion similarly as the size of silver halide grains control the speed of a conventional emulsion. However, in conventional emulsions speed is limited by acceptable granularity, which increases with increasing silver halide grain size. In the present invention increasing the size of dye crystals does not increase the size of the grains present and need not reduce their frequency of occurrence. It is therefore apparent that the photographic speed of the emulsions of this invention is not linked to granularity restraints in the same manner as in a conventional emulsion.

Beyond that, the ability to reduce grain size without decreasing photographic speed offers the opportunity to reduce granularity in relation to speed by employing the emulsions of this invention. By reducing grain size it is possible to increase the number of grains present without increasing silver coating coverages. The greater number of grains increases the number of developable centers and decreases the point to point fluctuations in image density that constitute perceived graininess or measurable granularity.

Another advantage of fundamental importance is the potential for being able to minimize fog. By relying on the host dye for photon capture the importance of chemical sensitization in achieving desired levels of photographic speed is relatively reduced. In other words, chemical sensitization can be discontinued at fog levels lower than now tolerated, since emulsion speeds are to a greater extent determined by the photon absorption capability of the host dye crystals and their ability to provide selectively only photogenerated electrons or holes to the grains. The emulsions of this invention can provide increased speed, reduced fog, or a combination of both.

In addition to the fog level which an emulsion exhibits attributable to the manner in which it is prepared, it is recognized that very high speed emulsions are sufficiently sensitive that background radiation, such as gamma rays emitted by radionuclides in soil and in building materials and cosmic rays (mostly muons at sea level), can increase the fog level of photographic elements on keeping. As discussed in *Research Disclosure*, Vol. 251, March 1985, Item 25113, susceptibility to background radiation fogging increases with increasing grain volumes. It is an advantage of the present invention that increased photographic speeds do not require increased silver halide grain volumes. Thus, the emulsions of this invention can exhibit reduced background radiation fogging susceptibility as a function of their photographic speeds.

Also of fundamental importance in the emulsions of the present invention, the surface area presented by the individual grains is not determinative of the amount of dye which can be present. Stated another way, desensitization experienced at higher dye concentrations in conventional emulsions is obviated. The size of a host dye crystal and hence the light gathering potential of that crystal as a receptor of exposing radiation can be entirely independent of the surface area of the grains. It is possible for a grain to have exactly the same conductive contact with a relatively large host dye crystal as it has with a relatively small host dye crystal.

Not only do the emulsions of the present invention escape the fundamental speed, fog, and granularity restraints found in conventional emulsions in which sensitizing dye is adsorbed to grain surfaces, the unprecedented freedom to manipulate sensitizing dye coating coverages independently of silver coating coverages allows higher dye to grain ratios than have heretofore been feasible. This in turn offers varied photographic advantages.

For example, increased sensitizing dye coating coverages can be employed to reduce contrast and to extend exposure latitude. Since unprecedentedly high dye coating coverages are possible, reductions in contrast and extensions of exposure latitude to a much greater extent than heretofore achieved with adsorbed sensitizing dyes is possible.

Another advantage made possible by higher dye coating coverages is increased sharpness. The host dye crystals can be employed to capture efficiently exposing light that has been scattered, as by deflection or reflection at boundaries of materials differing in their refractive indices. Since the ratio of dye to silver salt is not limited in any fundamental way, it is apparent that extremely sharp images should be achievable with the emulsions of this invention.

A particular need for improved image sharpness occurs in indirect radiography, wherein emulsion layers are coated on oposite sides of a transparent or tinted film support to form a dual coated radiographic element, and a phosphor intensifying screen is then positioned adjacent each emulsion layer. When the assembly is imagewise exposed, X radiation is adsorbed primarily by the phosphors in the screens, each of which emit light to expose the adjacent emulsion layer. To the extent that light from one screen exposes the emulsion layer on the opposite face of the film support a reduction in image sharpness occurs. This effect is referred in the art as crossover exposure or simply crossover. The high dye coating coverages made possible by the emulsions of the present invention make possible reduction or elimination of crossover, but without detracting from photographic speed, as occurs when crossover is reduced by using increased levels of adsorbed spectral sensitizing dye or light absorbing filter dyes.

Another advantage can be found in color photography, wherein superimposed blue, green, and red recording photograhic emulsion layers are employed. Since the silver halides commonly employed have a significant native sensitivity to the blue portion of the spectrum, green and red (minus blue) recording emulsion layers also possess appreciable blue sensitivity and must be protected against blue light exposures in order to avoid contamination of the minus blue record. By employing an emulsion according to the present invention in a blue recording layer of a color photographic element wherein the blue recording layer overlies at least one minus blue recording layer, it is possible to protect the underlying minus blue recording layer from unwanted blue light exposure. This approach to controling minus blue record contamination by blue light exposure takes advantage of the higher coating coverages of blue dye which can be incorporated in the overlying blue recording emulsion layer.

Another approach to controlling blue light contamination in the minus blue recording emulsion layer has no counterpart in the conventional silver halide color photography using adsorbed spectral sensitizing dyes. It is generally recognized that any technique for increasing the minus blue speed of a minus blue recording emulsion layer by a factor of 10 as compared to its blue speed will offer adequate practical protection against blue contamination of the minus blue record. In the present invention, by employing dye crystals capable of absorbing only minus blue light their light absorption can be controlled independently of that of the grains, which are themselves capable of absorbing only blue light. Thus, it possible to establish each of the minus blue and blue speeds independently of the other in an emulsion according to the invention, and the 10:1 ratio of minus blue to blue speed can not only be reached, but far exceeded. Therefore, emulsions satisfying the requirements of this invention can contain host dye crystals capable of absorbing blue or minus blue light and can be located in a color photographic element nearest the source of exposing radiation, farthest from it, or at any intermediate location. Further, although conventional techniques for minimizing blue contamination of the minus blue record are generally compatible with the emulsions of this invention, none is required to obtain excellent color replication.

Both the foregoing and additional advantages of this invention can be better appreciated by reference to the following detailed description of the invention considered in conjunction with the drawings.

DESCRIPTION OF PREFERRED EMBODIMENTS

Figure 1:
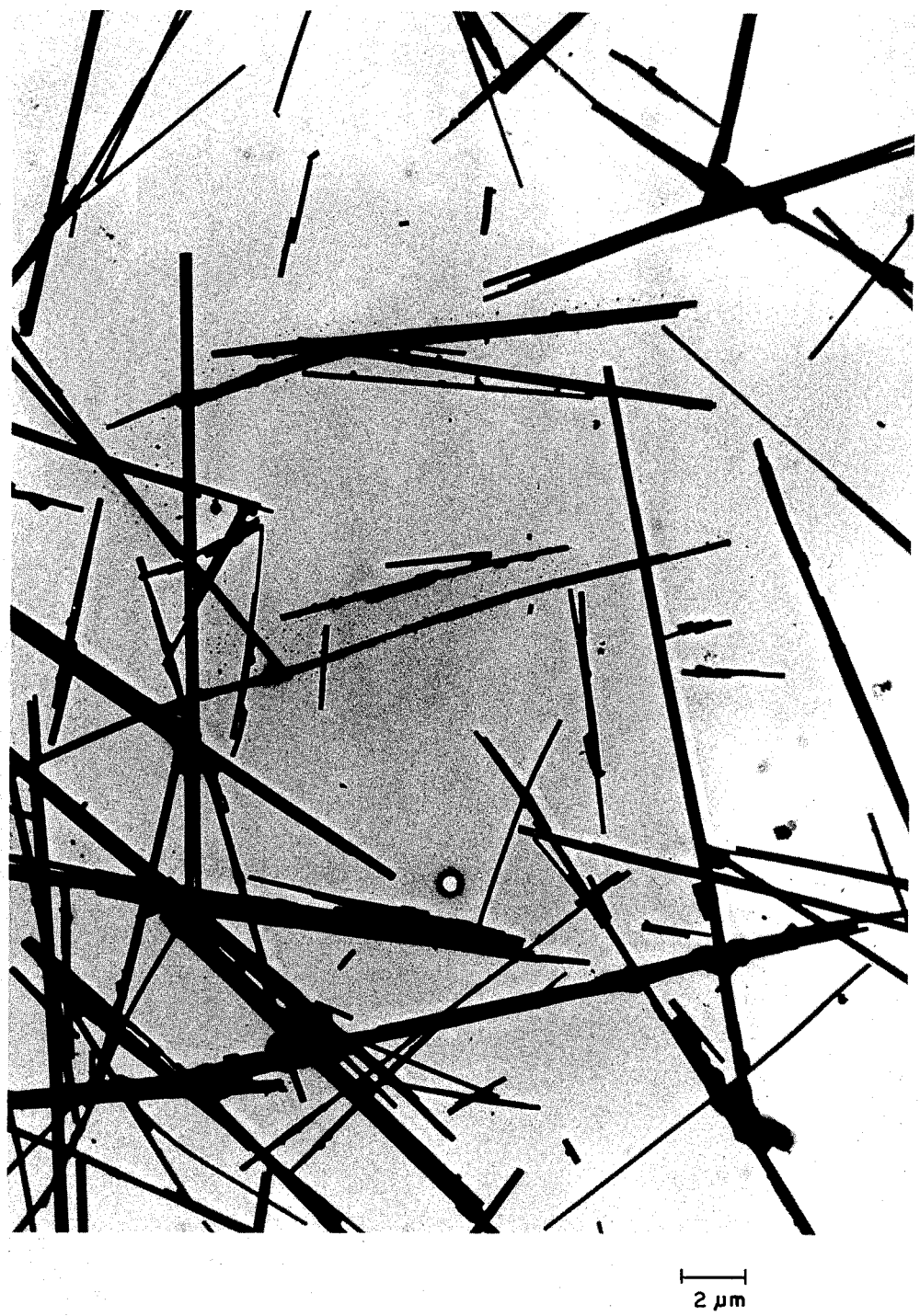
FIGS. 1 through 3 are electron micrographs, showing in FIG. 1 dye crystals and in FIGS. 2 and 3 grains conductively located on the dye crystals.

The photographic emulsions of this invention comprise a dispersing medium and at least one silver salt capable of forming a latent image conductively located on host sensitizing dye crystals.

Suitable host dyes can be selected from among a wide variety of known sensitizing dyes for silver halide emulsions. Sensitizing dyes can be selected from a variety of classes, but are most commonly selected from the polymethine dye class, which includes the cyanines, merocyanines, complex cyanines and merocyanines (i.e., tri-, tetra- and poly-nuclear cyanines and merocyanines), oxonols, hemioxonols, styryls, merostyryls and streptocyanines.

The cyanine spectral sensitizing dyes include, joined by a methine linkage, two basic heterocyclic nuclei, such as those derived from quinolinium, pyridinium, isoquinolinium, 3H-indolium, benz[e]indolium, oxazolium, thiazolium, selenazolinium, imidazolium, benzoxazolinium, benzothiazolium, benzoselenazolium, benzimidazolium, naphthoxazolium, naphthothiazolium, naphthoselenazolium, thiazolinium dihydronaphthothiazolium, pyrylium and imidazopyrazinium quaternary salts.

The merocyanine spectral sensitizing dyes include, joined by a methine linkage (which includes a double bond or zero methine linkage), a basic heterocyclic nucleus of the cyanine dye type and an acidic nucleus, such as can be derived from barbituric acid, 2-thiobarbituric acid, rhodanine, hydantoin, 2-thiohydantoin, 4-thiohyantoin, 2-pyrazolin-5-one, 2-isoxazolin-5-one, indan-1,3-dione, cyclo-1,3-dione, 1,3-dioxane-4,6-dione, pyrazolin-3,5-dione, penta-2,4-dione, alkylsulfonyl acetonitrile, malononitrile, isoquinolin-4-one, and chroman2,4-dione.

Dyes which desensitize negative working silver halide emulsions are generally useful as electron accepting spectral sensitizers for direct positive emulsions containing surface fogged silver halide grains. typical heterocyclic nuclei featured in cyanine and merocyanine dyes well suited for use as sensitizers in fogged direct positive emulsions are those derived from nitrobenzothiazole, 2-aryl-1-alkylindole, pyrrolo[2,3-b]pyridine, imidazo[4,5-b-]quinoxaline, carbazole, pyrazole, 5-nitro-3H-indole, 2-arylbenzindole, 2-aryl-1,8-trimethyleneindole, 2-heterocyclylindole, pyrylium, benzopyrylium, thiapyrylium, 2-amino-4-aryl-5-thiazole, 2-pyrrole, 2-(nitroaryl)indole, imidazo[1,2-a]pyridine, imidazo[2,1-b]thiazole, imidazo[2,1-b]-1,3,4-thiadiazole, imidazo[1,2-b]pyridazine, imidazo[4,5-b]quinoxaline, pyrrolo[2,3-b]quinoxaline, pyrrolo[2,3b]pyrazine, 1,2-diarylindole, 1-cyclohexylpyrrole and nitrobenzoselenazole.

Illustrative of known sensitizing dyes for silver halide emulsions which employ photogenerated electrons to form latent images are those found in U.K. Pat. 742,112, Brooker U.S. Pats. Nos. 1,846,300, '301, '302, '303, '304, 2,078,233 and 2,089,729, Brooker et al U.S. Pats. Nos. 2,165,338, 2,213,238, 2,493,747, '748, 2,526,632, 2,739,964 (U.S. Pat. No. Re. 24,292), 2,778,823, 2,917,516, 3,352,857, 3,411,916 and 3,431,111, Sprague U.S. Pat. No. 2,503,776, Nys et al U.S. Pat. No. 3,282,933, Riester U.S. Pat. No. 3,660,102, Kampfer et al U.S. Pat. No. 3,660,103, Taber et al U.S. Pats. Nos. 3,335,010, 3,352,680 and 3,384,486, Lincoln et al U.S. Pat. No. 3,397,981, Fumia et al U.S. Pats. Nos. 3,482,978 and 3,623,881, Spence et al U.S. Pat. No. 3,718,470 and Mee U.S. Pat. No. 4,025,349. Among dyes useful as spectral sensitizers for emulsions which employ photogenerated holes for latent image formation, such as fogged direct positive emulsions, are those found in Kendall U.S. Pat. No. 2,293,261, Coenen et al U.S. Pat. No. 2,930,694, Brooker et al U.S. Pat. No. 3,431,111, Mee et al U.S. Pats. Nos. 3,492,123, 3,501,312 and 3,598,595, Illingsworth et al U.S. Pat. No. 3,501,310, Lincoln et al U.S. Pat. No. 3,501,311, VanLare U.S. Pat. No. 3,615,608, Carpenter et al U.S. Pat. No. 3,615,639, Riester et al U.S. Pat. No. 3,567,456, Jenkins U.S. Pat. No. 3,574,629, Jones U.S. Pat. No. 3,579,345, Mee U.S. Pat. No. 3,582,343, Fumia et al U.S. Pat. No. 3,592,653 and Chapman U.S. Pat. No. 3,598,596.

Spectral sensistizing dyes are normally precipitated as crystals when synthesized to facilitate washing and purification. Thus, the host sensitizing dye crystals of the emulsions of this invention can be provided merely by employing known crystallization techniques in the preparation of conventional sensitizing dyes.

It is preserred that the dyes be precipitated to control crystal sizes. While useful crystal sizes can vary widely, depending upon the particular photographic application to be served, it is generally preferred to employ host crystals in the same size ranges as conventional radiation-sensitive silver salt grains. Like latent image forming silver salt grains contained in conventional photographic emulsions the host dye cyrstals are microcrystals—that is, too small to be observed with the unaided eye. For the majority of photographic applications the mean host dye crystal diameters are within the range of from about 0.1 to 5 micrometers ($\mu$m). For exceptionally high speed or low image definition applications host dye crystal diameters can range up to 20 $\mu$m or more. Host dye crystal mean diameters in the range of from about 0.2 to 2$\mu$m are preferred for most photographic applications. Exceedingly fine host dye crystals are possible, comparable to the grain sizes found in Lipmann emulsions. While such small host dye crystal sizes are expected to offer low photographic speeds, unless conductively associated with larger silver halide grains, such small host dye crystals should have utility in applications where photographic speed is of secondary interest, such as in forming photographic prints or microfilm images. Since crystal size is generally recognized to be an inverse function of the rapidity with which the crystals are formed, the mean host crystal sizes can be controlled merely by regulating the rate of precipitation. Precipitations driven by slight departures from equilibrium conditions can be employed to produce larger host crystal sizes while agitation and rapid or dump addition of precipitating reagents can be relied upon to produce smaller crystal sizes.

While it is known that conventional spectral sensitizing dyes can be crystallized, it is also known that many of these dyes have been specifically tailored for solubilization in emulsion dispersing media. For example, sulfoalkyl substituents are favored over alkyl substituents in conventional cyanine sensitizing dyes to enhance their solubility. In the practice of the present invention at no point is it necessary to solublize the sensitizing dyes in the dispersing medium of the emulsion. Thus, the chromophore portions of the dyes selected for host crystals can correspond to those of conventional spectral sensitizing dyes, but the non-chromophore substituents can be chosen on the basis of synthetic convenience or on the basis of their ability to enhance the desired crystallization.

Since the host dye crystals can be relied upon as the primary photoreceptors of the emulsions of this invention, it is appreciated that the distribution of host dye crystal sizes can affect photographic properties in much the same way that the distribution of silver halide grain sizes affect photographic properties in conventional photographic emulsions. For example, by employing monodisperse host dye crystal populations, it should be possible to increase image contrast and reduce exposure latitude. By providing a more heterodisperse host dye crystal population, by precipitating the dye crystals in this form or by blending dye crystal populations of differing mean diameters, extended latitude, reduced contrast, or even stepped contrast should be realizable. Wey et al U.S. Pat. No. 4,55,838 is referred to for a better appreciation of effects of various photoreceptor size distributions on photographic response.

The silver salt grains in conductive contact with the host dye crystals can be of any grain composition known to be capable of forming a developable latent image. Although silver halides are the latent image forming silver salts most commonly employed in photography, a variety of other such silver salts are generally known, such as silver thiocyanate, silver phosphates, silver cyanide, and silver carbonate, disclosed, for example, in Berriman U.S. Pat. No. 3,367,778 and Maskasky U.S. Pat. No. 4,471,050, the disclosures of which are here incorporated by reference.

Preferred latent image forming grains are comprised of silver halide. They can be comprised of silver bromide, silver chloride, silver iodide, silver chlorobromide, silver chloroiodide, silver bromoiodide, silver chloroiodide, silver chlorobromoiodide, or mixtures thereof. Various ions, referred to as dopants, such as sulfur, selenium, tellurium, copper, thallium, lead, bismuth, cadmium, gold, and Group VIII noble metals, can be present in the grains in conventional concentrations. Emulsions with silver halide grains containing such occluded ions are illustrated by Arnold et al U.S. Pat. No. 1,195,432, Hochstetter U.S. Pat. No. 1,951,933, Trivelli et al U.S. Pat. No. 2,448,060, Overman U.S. Pat. No. 2,628,167, Mueller et al U.S. Pat. No. 2,950,972, Sidebotham U.S. Pat. No. 3,488,709 and Rosecrants et al U.S. Pat. No. 3,737,313. Dopants are commonly employed to control fog, contrast, or sensitivity or to shift the site of latent image formation from the surface to the interior of the grains.

The grains can take any convenient crystalline form. The grains can be of any regular or irregular (e.g., twinned) crystal shape. Where the silver halide favors a cubic crystal lattice structure, which is the case for all silver halides except silver iodide, the grains can be bounded by crystal faces of any of the seven possible forms or, in the case of irregular grain shapes, by combinations of these forms. The silver iodide grains can be comprised of $\alpha$, $\beta$, $\gamma$, or mixed phase silver iodide and exhibit any of the crystal forms typical of the these crystal lattice forms of silver iodide. Maskasky U.S. Pat. No. 4,471,050, cited above, demonstrates varied crystal forms of other useful silver salts.

The grains are in conductive contact with the host dye crystals. Although it should be possible to interpose a conductor linking a grain and its host dye crystal, a simple arrangement is for the grain to be in direct contact with at least one crystal face of the dye. The basic imaging unit of the emulsions of this invention is a host dye crystal conductively associated with at least one grain. The host dye crystal acts as a photoreceptor for photon capture while the grain provides a site for latent image formation. A single host dye crystal requires only a single conductively associated grain, but it is specifically contemplated that a plurality of grains can share the same host dye crystal and in the limiting case the host crystal can be effectively shelled by the silver salt. Minimizing the mean conduction path between the site of photon absorption by the dye crystal and the grain site will, of course, minimize the opportunity for photon imparted energy dissipation in the dye crystal. However, closely adjacent placement of grain sites on the same host crystal can lead to competition for photon imparted energy, resulting in separate grains each capturing some of the available energy, but none capturing enough to form a developable latent image. An optimum number and spacing of grains on a host dye crystal depends on conduction losses in the host dye crystal, the size and geometry of the host dye crystal, the relative size of the grains, and the relative importance of speed as opposed to image definition.

One way of defining the grain to host dye crystal relationship is in terms of the moles of dye contained in the host crystals per mole of silver contained in the silver salt forming the grains. While wide variations are possible, the dye will usually range from 0.5 millimole, preferably at least 1 millimole, and most preferably at least 5 millimoles per silver mole up to 5000 millimoles, preferably up to 500 millimoles, and optimally up to 100 millimoles of dye per mole of silver.

Any convenient technique for conductively locating the grains on the host dye crystals can be employed. One preferred approach is to precipitate the silver salt grains in the presence of the host dye crystals in a manner essentially similar to that employed for preparing conventional photographic emulsions containing grains of the same silver salt. However, to assure direct (preferably epitaxial) deposition of the grains on the host dye crystal faces, it is preferred that no peptizer be present during grain nucleation. Once grain nucleation has occurred, continued grain growth can occur in the presence of conventional emulsion peptizers. Mignot U.S. Pat. No. 4,334,012 is illustrative of a particularly preferred procedure for the nucleation and initial growth of emulsion grains in the absence of a peptizer. Although single jet precipitations of grains with the host dye crystals suspended in the halide salt solution should be possible, it is preferred to suspend the host dye crystals in a nonsolvent liquid medium and to perform a conventional double jet addition into the liquid medium. Both single and double jet aqueous medium precipitation procedures readily adapted to the practice of the invention are disclosed in *Research Disclosures,* Vol. 176, December 1978, Item 17643, Section I.

It is also possible to employ a nonaqueous medium for precipitation. This can be advantageous where the host dye crystals are water soluble. For example, a liquid dispersing medium can be chosen from a variety of known polar organic liquids, such as ketones, aldehydes, and esters, which are not solvents for the sensitizing dye. Silver and counterion salts which are soluble in the polar organic liquid can then be introduced and reacted. The addition of tetra-t-butyl ammonium chloride and silver trifluoroacetate to a dispersing medium of ethyl acetate is shown in the examples below to be effective in preparing an emulsion according to the present invention.

Once the desired conductive relationship has been established between the grains and the host dye crystals, any of a wide variety of conventional emulsion preparation techniques can be employed to bring the emulsion to a completed form. In one approach peptizer can be added to the dispersing medium containing the host dye crystals and partially grown grains and precipitation completed by conventional techniques. Further, washing, addenda additions, support selection, and coating to form a completed photographic element can follow conventional teachings, such as, for example, those contained *Research Disclosure* 17643, cited above.

Variations from conventional procedures can be undertaken based on the specific characteristics of the emulsions being prepared. For example, the silver salt initially precipitated can differ from the silver salt chosen to complete grain growth. It is specifically contemplated that one silver salt can be chosen to establish the desired host dye crystal interface with another silver salt epitaxially grown thereon better suited for latent image formation. Sensitization of the grains through the use of conventional chemical sensitizers (including sensitizing dyes) is possible. Chemical sensitization can be effective in increasing the effectiveness of latent image formation, but eliminating the chemical sensitization step can reduce the maximum temperature to which the emulsion is subjected. In most instances no additional sensitizing dye, either incorporated during grain growth or adsorbed to the grain surface after formation is needed. It is specifically contemplated to modify the photon abssorption capabilities of the host dye crystals by adsorbing one or more conventional spectral sensitizing dyes. This approach offers the potential of achieving supersensitizing dye combinations not possible using crystals of a single dye.

The dispersing medium present in the emulsion can take the form of any conventional emulsion vehicle and typically includes both a grain peptizer introduced during precipitation and a binder. For emulsions formed in aqueous media the preferred vehicles include hydrophilic colloids, such as gelatin and gelatin derivatives. Such vehicles and hardeners therefor are illustrated by *Research Disclosure,* Item 17643, cited above, Sections IX and X. For nonaqueous emulsions poly(vinyl butyral) is a commonly employed vehicle.

Emulsion and photographic element features and manufacturing techniques such as antifoggants and stabilizers, ingredients for producing dye images, optical brighteners, coating aids, plasticizers and lubricants, methods of ingredient addition, the photographic support, and coating and drying procedures, can all take conventional forms as illustrated by *Research Disclosure,* Item 17643, cited above.

The emulsions and photographic elements of this invention can be imagewise exposed in any conventional manner, such as illustrated by Research Disclosure, Item 17643, cited above, Section XVIII. In the simplest application of the invention the host dye crystals are chosen so that they are capable of efficiently absorbing radiation employed for imagewise exposure. The host dye crystals are typically chosen to exhibit peak absorptions in any region of the spectrum ranging from the near ultraviolet at about 300 nm to the near infrared at wavelengths up to about 1200 nm. In most instances the host dye crystals are chosen to record imagewise exposures in the visible portion of the spectrum ranging from about 400 to 700 nm.

For black-and-white photography orthochromatic or panchromatic sensitivities are often desired. Since a single sensitizing dye rarely absorbs light efficiently over more than a third of the visible spectrum, it is recognized that emulsions according to this invention containing mixtures of host dye crystals capable of absorbing at differing wavelengths can be useful. It is possible to prepare blends of host dye crystals prior to grain nucleation in order to obtain extended emulsion spectral senstivity, but it is preferred in most instances to blend emulsions containing host crystals different dyes after grain formation has been completed. This avoids disproportionate deposition of silver salt on one host dye crystal population as opposed to another. Another approach for extending the spectral response of an emulsion according to the invention is to adsorb a sensitizing dye differing in its wavelength of peak absorption from that of the host dye grains onto the grains present in the emulsion.

Where an emulsion is intended to receive both imagewise and uniform exposures to light, such as in direct print and printout emulsions, the host dye crystals can be chosen to absorb light during either or both exposures. Conventional emulsion adaptations for direct print and printout applications are compatible with the emulsions of this invention and can be specifically incorporated, if desired. For conventional printout and direct print features attention is directed to *Research Disclosure,* Item 17643, cited above, Sections XXVI and XXV.

It is further possible to blend any conventional emulsion with an emulsion according to this invention in order to achieve modified properties, including modified spectral properties. Conventional photographic emulsions are illustrated by *Research Disclosure,* Item 17643, cited above, Section I. Additionally, in constructing a photographic element according to this invention, it is possible to employ the emulsions of this invention in one layer of the photographic element and to employ a conventional photographic emulsion in another layer.

Photographic processing, including processing features incorporated in the photographic elements, such as developing agents and development modifiers, can take any convenient conventional form, such as illustrated by *Research Disclosure,* Item 17643, cited above, Sections XIX, XX, and XXI. The host dye crystals can be removed from the photographic element during processing by the same procedures employed to remove conventional absorbed sensitizing dyes, filter dyes, and antihalation dyes.

Since photographic elements according to this invention can take widely differing forms, depending upon the application to be served, the following are intended as specific illustrations:

I. Black-and-White Photographic Film

A transparent cellulose triacetate film support is provided. On the support is coated an orthochromatically sensitized emulsion according to the present invention. The emulsion is comprised of phthalated gelatin employed as a vehicle hardened with a vinylsufonyl hardener, such as bis(vinylsulfonyl)methane or bis(vinylsulfonylmethyl) ether. Dispersed in the vehicle are host dye crystals having a peak absorption in the green (520 to 580 nm) region of the spectrum and negligibly low levels of absorption in the visible spectrum at wavelengths shorter than than 480 nm and longer than 620 nm, such as crystals of anhydro-5-chloro-9-ethyl-5'-phenyl-3'-(3-sulfobutyl)-3-(3-sulfopropyl) oxacarbocyanine hydroxide, sodium salt. Silver bromoioidide grains containing 0.5 to 20, preferably 1 to 12, mole percent iodide, based on silver, are conductively supported on the host dye crystals. The silver bromoiodide grains are prepared in the presence of 0.12 mg/Ag mole ammonium hexachlororhodate to increase contrast and are sulfur and gold sensitized. The emulsion additionally contains an antifoggant, such as a polyazaindene of the type disclosed in *Research Disclosure,* Vol. 148, August 1976, Item 14851-e.g., 2-carboxymethylthio-4-hydroxy-5-methyl-1,3,3a,7-tetraazaindene. The photographic element additionally includes a transparent gelatin overcoat and poly(methyl methacrylate) beads acting as a matting agent.

The photographic element when imagewise exposed and developed in a conventional black-and-white developer, such as an N-methyl-p-aminophenol hemisulfate (Elon ®)-hydroquinone developer, followed by fixing and washing produces a monochromatic negative image.

Instead of or in addition to the green absorbing host dye crystals red absorbing host dye crystals can be employed for this use. The silver bromoioide grains are relied upon for blue light absorption, but the silver bromoiodide grains can in part be conductively supported on blue absorbing host dye crystals, if desired. A phenylmercaptotetrazole and benzothiazole are commonly employed in combination with or in place of the polyazaindene antifoggant.

To increase the contrast of the photographic element it is specifically contemplated to employ monodisperse host dye crystals of 0.3 μm or less in mean diameter, to incorporate an arylhydrazide, such as disclosed in *Research Disclosure,* Vol. 235, Nov. 1983, Item 23510, and to employ as an antifoggant a triazole, such 3-methylbenzotriazole. The formation of direct positive images by using internal latent image forming silver halide grains as taught by Silverman et al U.S. Pat. Nos. 4,444,865 and 4,444,874, is specifically contemplated.

There are, of course, numerous other variations possible, which will be readily appreciated by those skilled in the art.

II. Dual Coated Radiographic Film

A blue tinted transparent poly(ethylene terephthalate) film support is provided. On each of the opposite major faces of the support is coated a green sensitized emulsion according to the present invention. The emulsion is comprised of a low methionine (less than 30 micromoles per gram) gelatin employed as a vehicle partially forehardened with formaldehyde or a bis(-vinylsulfonyl) hardener to an extent sufficient to permit handling prior to processing. Dispersed in the vehicle are host dye crystals having a peak absorption in the blue or green region of the spectrum at a wavelength approximating the peak emission wavelength of phosphor intensifying screens intended to be used therewith, such as blue emitting calcium tungstate phosphor screens or green emitting rare earth activated gadolinium oxysulfulide or oxyhalide phosphor screens. The host dye crystals are from about 0.6 to 2.0 μm in mean diameter. Sulflur and gold sensitized silver bromide grains are conductively supported on the host dye crystals. The emulsion additionally contains an antifoggant, such as 1-phenyl-5-mercaptotetrazole. The radiographic element additionally includes a transparent gelatin overcoat and latex beads acting as a matting agent.

The radiographic element when placed in a cassette between phosophor intensifying screens and imagewise exposed to X radiation produces a latent image, but experiences a minimal level of crossover exposure. The radiographic element can be processed in a conventional rapid access roller transport processor, such as disclosed in the examples of Dickerson U.S. Pat. No.

4,520,098. Typically a conventional developer, such as an N-methyl-p-aminophenol hemisulfate (Elon®)-hydroquinone developer, containing a prehardener, such as glutaraldehyde is employed.

Instead of or in addition to the phenylmercaptotetrazole antifoggant polyazaindenes or benzothiazoles are commonly employed. Instead of employing silver bromide to form the grains, a silver bromoiodide can be alternatively employed. It is specifically contemplated to employ a silver bromoiodide emulsion according to the present invention in combination with an internally fogged silver halide emulsion which is blended or incorporated in a separate layer, as taught by Luckey U.S. Pat. No. 2,996,382. There are, of course, numerous other variations possible, which will be readily appreciated by those skilled in the art.

III. Multicolor Photographic Element

A multicolor, incorporated coupler photographic element can be prepared by coating the following layers on a cellulose triacetate film support in the order recited:

- Layer 1: Slow Cyan Layer—comprising red-sensitized silver bromoiodide grains, gelatin, a cyan image-forming coupler, colored coupler, and DIR coupler.
- Layer 2: Fast Cyan Layer—comprising faster red-sensitized silver bromoiodide grains, gelatin, a cyan image-forming coupler, colored coupler, and DIR coupler.
- Layer 3: Interlayer—comprising gelatin and antistain agent.
- Layer 4: Slow Magenta Layer—comprising green-sensitized silver bromoiodide grains, gelatin, a magenta image-forming coupler, colored coupler, DIR coupler, and antistain agent.
- Layer 5: Fast Magenta Layer—comprising faster green-sensitized silver bromoiodide grains, gelatin, a magenta image-forming coupler, colored coupler, and antistain agent.
- Layer 6: Interlayer—comprising gelatin and antistain agent.
- Layer 7: Yellow Filter Layer—comprising yellow colloidal silver and gelatin.
- Layer 8: Slow Yellow Layer—comprising blue-sensitized silver bromoiodide grains, gelatin, a yellow dye-forming coupler, and antistain agent.
- Layer 9: Fast Yellow Layer—comprising faster blue-sensitized silver bromoiodide grains, gelatin, a yellow-forming coupler and antistain agent.
- Layer 10: UV Absorbing Layer—comprising the UV absorber 3-(di-n-hexylamino)allylidenemalononitrile and gelatin.
- Layer 11: Protective Overcoat Layer—comprising gelatin and bis(vinylsulfonylmethyl)ether.

The silver halide emulsions in each color image forming layer commonly conventionally contain polydisperse, low aspect ratio grains of the type described in Illingsworth U.S. Pat. No. 3,320,069 or can alternatively contain at least in the faster emulsion layers high aspect ratio tabular grains of the type disclosed in Kofron et al U.S. Pat. No. 4,439,520, all optimally sensitized with sulfur and gold in the presence of thiocyanate and spectrally sensitized to the appropriate regions of the visible spectrum with various spectral sensitizing dyes adsorbed to the grain surfaces. Couplers and antistain agents, not identified by formula above, can be chosen from among various conventional materials, such as those disclosed in *Research Disclosure,* Item 17643, cited above, Section VII.

Substitution of an emulsion according to this invention in any one or combination of the layers of above can result in a multicolor photographic element according to this invention. For example, by using an emulsion according to this invention in either of Layers 8 or 9 can provide sufficient protection from blue light absorption in the underlying emulsion layers to allow Layer 7 to be eliminated. Use of an emulsion according to the present invention in any or all of the minus blue recording layers, Layers 1, 2, 4, and 5, can be used to increase the minus blue to blue speed differences of these emulsions layers, thereby increasing the fidelity with which minus blue record is created.

An example of a blue sensitizing dye which can be used to form host dye crystals for either or both of the blue recording emulsion layers, Layers 8 and 9, is anhydro-5,5'-dichloro-3,3'-bis(3-sulfopropyl) thiacyanine hydroxide, triethylamine salt. An example of a green sensitizing dye which can be used to form host dye crystals for either or both of the green recording emulsion layers, Layers 4 and 5, is anhydro-5-chloro-9-ethyl-5'-phenyl-3'-(3-sulfobutyl)-3-(3-sulfopropyl)oxacarbocyanine hydroxide, sodium salt. An example of a red sensitizing dye which can be used to form host dye crystals for either or both of the green recording emulsion layers, Layers 1 and 2, is anhydro-9-ethyl-3,8-ethylene-5,5'-dimethoxy-3'-(3-sulfopropyl) thiacarbocyanine hydroxide.

The multicolor photographic element can be processed in a color developer of the type described in *British Journal of Photography Annual,* 1979, pp. 204–206.

EXAMPLES

The invention can be further appreciated by reference to the following examples:

EXAMPLE 1

Example 1 illustrates the blue spectral sensitization of a silver chloride emulsion precipitated on preformed crystals of Dye I, anhydro-5,5'-dichloro-3,3'-bis(3-sulfopropyl) thiacyanine hydroxide, triethylamine salt. A silver chloride emulsion control precipitated in the usual manner in the absence of dye, but simply mixed with the dye crystals after precipitation, showed no blue sensitization under the exposure condition used for the emulsion of the invention. A second control silver chloride emulsion, prepared by the same precipitation as the first control emulsion and conventionally sensitized with Dye I after precipitation of the emulsion was complete, showed the expected degree of blue sensitization. No image was formed when the dye crystals were coated in the absence of silver chloride. The emulsions were not chemically sensitized.

EXAMPLE 1A

CONTROL AGCL EMULSION

The control emulsion consisted of cubic silver chloride grains of mean size about 0.22 μm, with no chemical sensitization. A portion of the emulsion was conventionally spectrally sensitized with 4.0 mmol/Ag mole of Dye I.

EXAMPLE 1B

DYE I CRYSTAL SUSPENSION

Dye I, 6.97 g (10 mmol) was dissolved at room temperature in 5L of methanol. With stirring, 1L of 1.0M aqueous $KNO_3$ solution was added. The dye crystals were allowed to settle out overnight. The supernatant was poured off, and the precipitate redispersed in 5L of water. This was allowed to settle overnight, and the supernatant poured off. The washing procedure was repeated once more. A 6,000 X transmission electron micrograph (TEM) of the resulting crystals is shown in FIG. 1.

EXAMPLE 1C

SILVER CHLORIDE PRECIPITATED ON DYE I CRYSTALS

A portion of the dye preparation Example 1B containing about 2.5 mmol of Dye I crystals was placed in a reaction vessel equipped with a stirrer and made up to 300 cc with water. At room temperature over a period of 10 min, a 0.50M solution of $AgNo_3$ and a 0.50M solution of KCl were simultaneously added at a rate of 10 cc/min consuming 0.05 moles Ag. The temperature was raised to 35° C., and a solution of 18 g of deionized bone gelatin was added. The ratio of dye crystals to silver chloride was thus 50 mmol/Ag mole.

Figure 2:
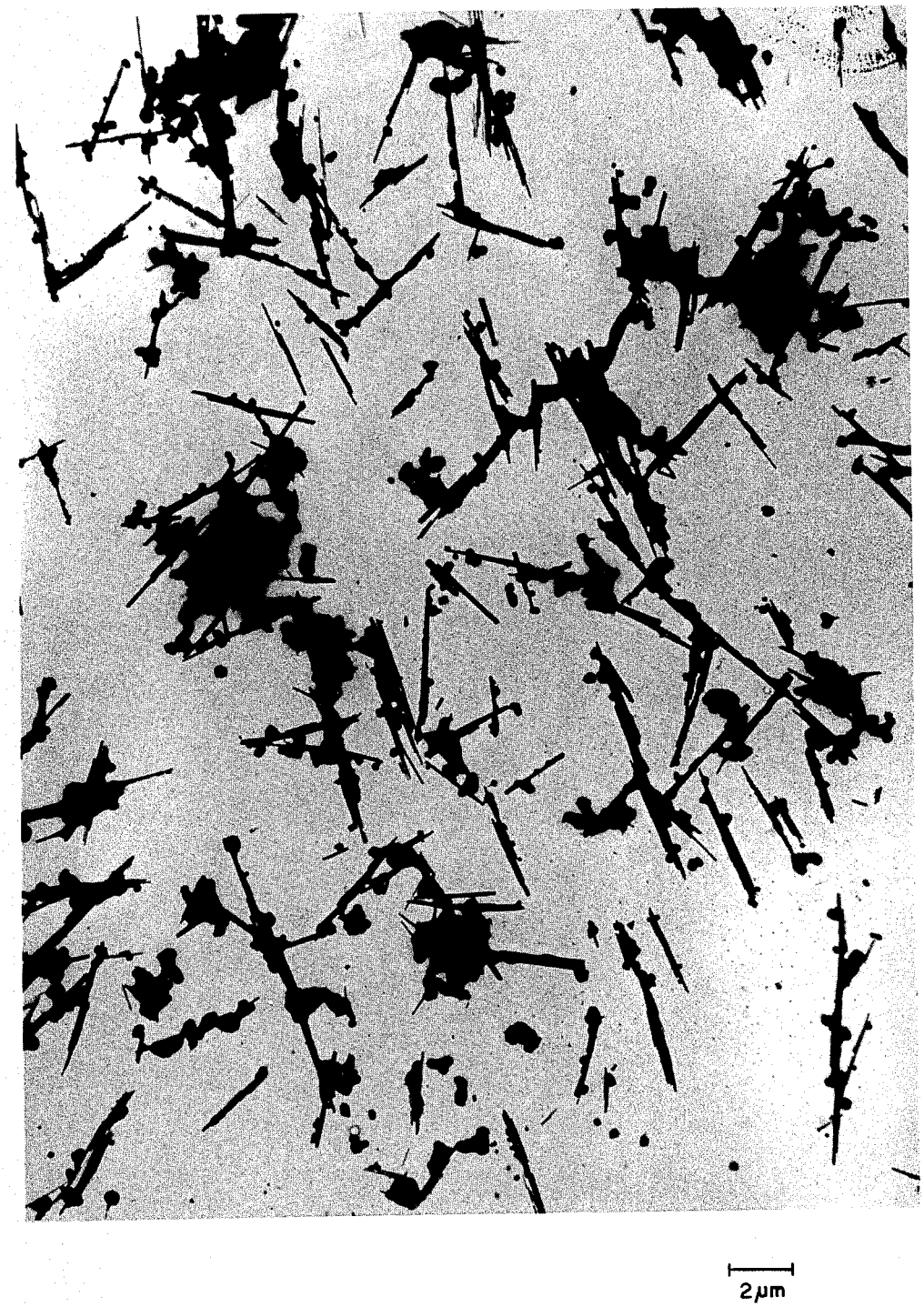
Figure 3:
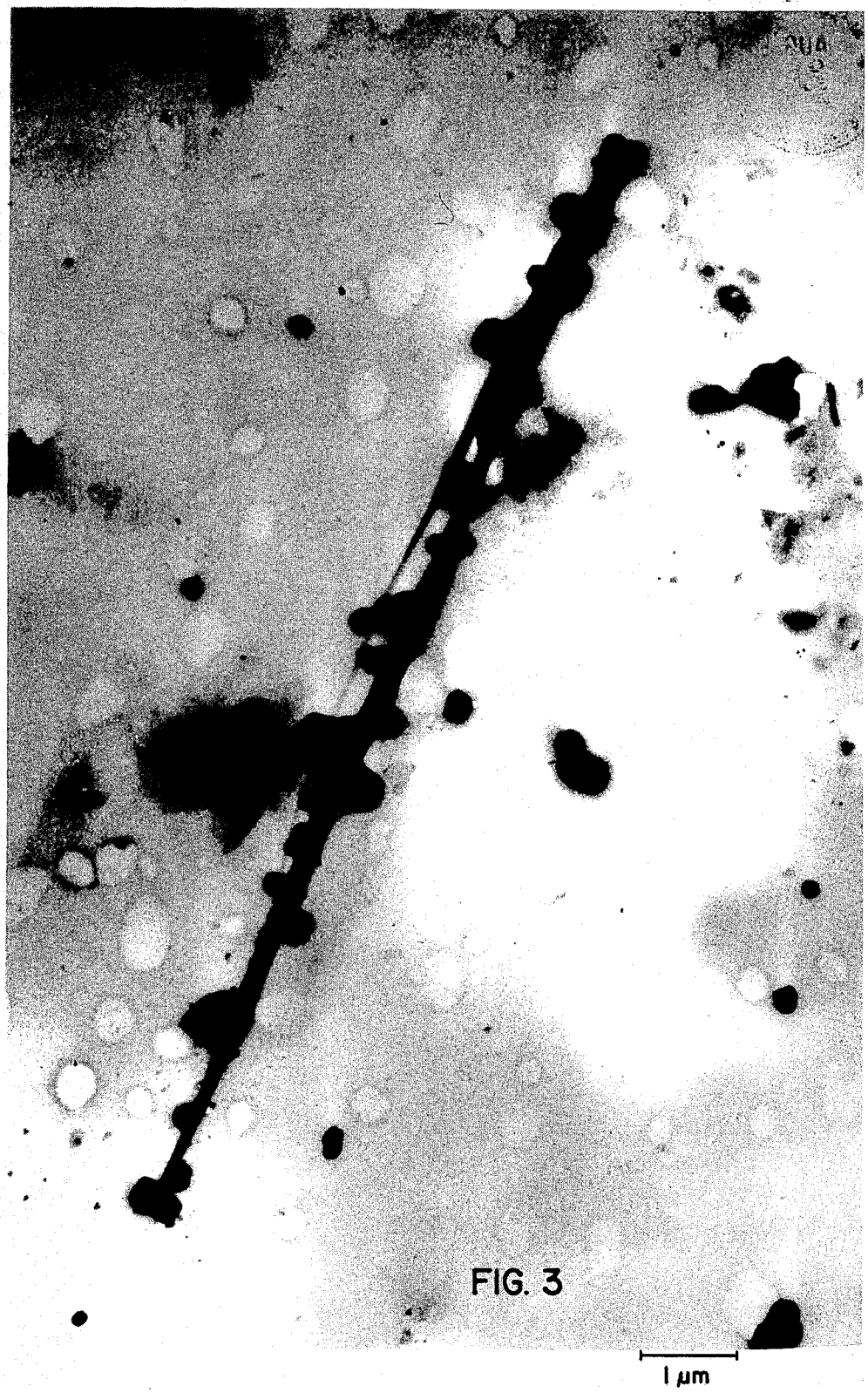

FIGS. 2 and 3 are 6,000 X and 20,000 X, respectively, TEM's of the resulting emulsion, showing the AgCl crystals of roughly 0.2 μm mean grain size which have grown attached to the dye crystals.

EXAMPLE 1

COATINGS

Coating 1 Conventionally Dyed AgCl Emulsion (Control 1)

The conventionally dyed Emulsion Example 1A was coated on a cellulose acetate support at 0.39 g/m$^2$ Ag, 6.5 g/m$^2$ gelatin, and overcoated with 0.89 g/m$^2$ gelatin. The coating was hardened with bis(vinylsulfonylmethyl) ether at 1.75 % of the total gelatin level. A sample of the coating was exposed for 20 sec in a spectral sensitometer to a quartz-halogen light source through a Wratten 80B® color correcting filter, diffraction grating with filters to remove second order transmission, and superimposed step wedge. The coatings were developed for 6 min at 38° C. in KODAK E6® first developer, fixed, washed and dried. A Density vs. Log Exposure curve (D log E) was determined for each coating at 380 nm and at each 10 nm interval between 380 nm and 700 nm. The speed at 0.3 density units above fog was read from each D log E curve, adjusted for a uniform energy distribution over the spectral range, and plotted against wavelength to obtain the relative log spectral sensitivity curve shown in FIG. 4.

Coating 2

Control Emulsion Mixed with Dye Crystals (Control 2)

Coating 2 was prepared like Coating 1, but using Emulsion Example 1A without spectral sensitization. Instead, 50 mmole/Ag mole of the dye crystals of Example 1B were mixed into the emulsion before coating. A sample of the coating was exposed and processed as described for Coating 1, but showed no discernible image for the 20 sec. spectral sensitometer exposure.

Coating 3 Dye Crystals Alone (Control 3)

Coating 3 was prepared like Coating 1, but omitting the AgCl emulsion and adding only an amount of Dye I crystals of Example 1B corresponding to the amount coated in Coating 4 below. No image was obtained after exposure and processing as described for Coating 1.

Coating 4 Emulsion Precipitated on Dye Crystals (Invention)

Figure 5:
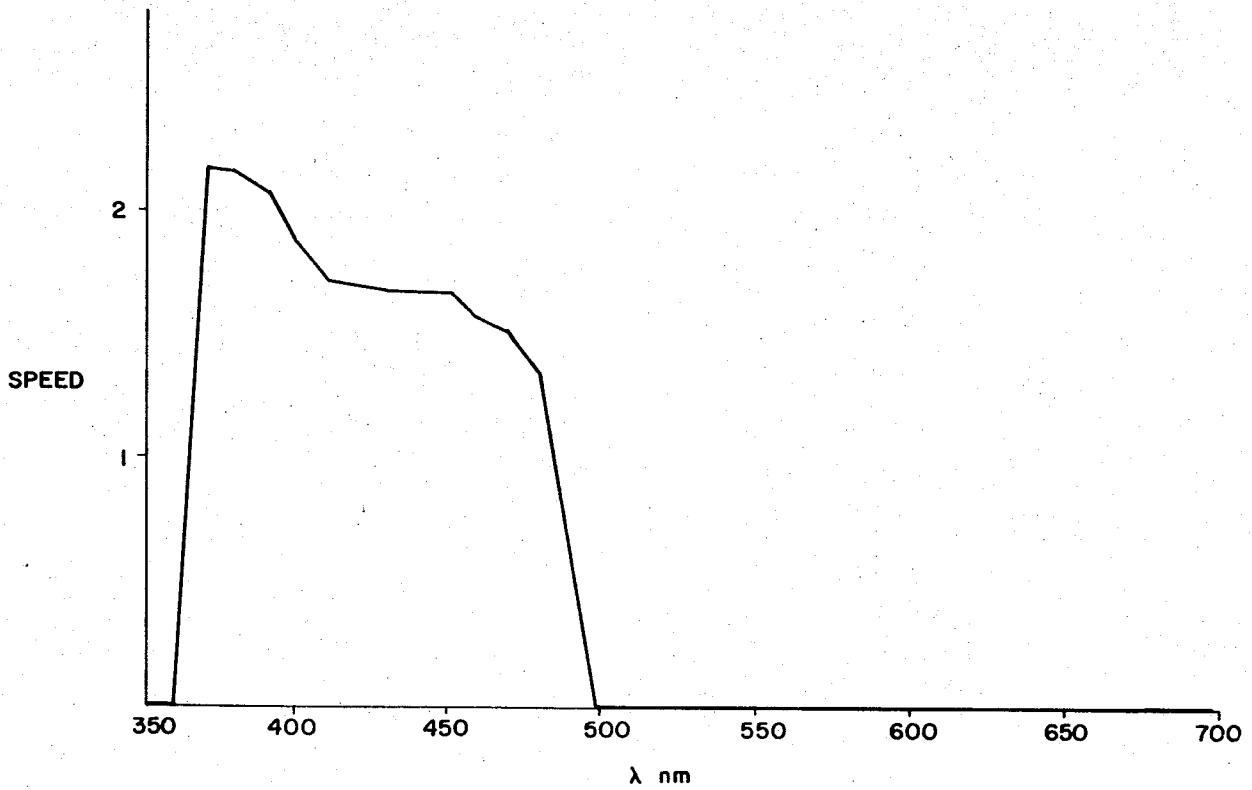

Coating 4 was prepared like Coating 1 but using Emulsion Example 1C of the invention at 0.39 g/m$^2$ Ag (50 mmole Dye I/Ag mole). After exposure and processing as described for Example 1, the relative log spectral sensitivity curve of FIG. 5 was obtained.

Coating 5 Emulsion Precipitated on Dye Crystals (Invention)

Coating 5 was prepared like Coating 4, but the emulsion Example 1 was coated at 1.13 g/m$^2$ Ag (50 mmole Dye I/Ag mole). The relative log spectral sensitivity curve of FIG. 6 was obtained.

EXAMPLE 1

RESULTS

Figure 4:
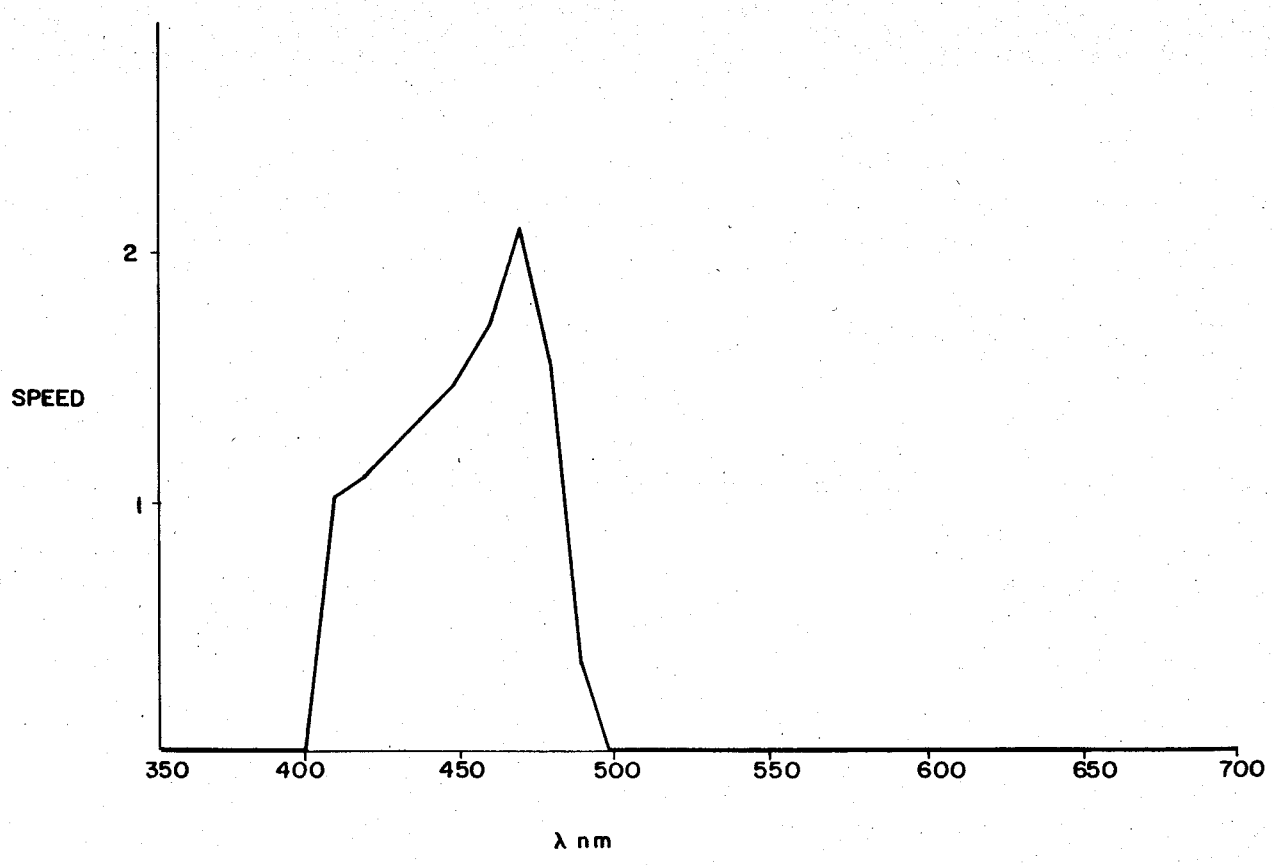
FIGS. 4 through 6 are plots of speed versus wavelength of exposure.
Figure 6:
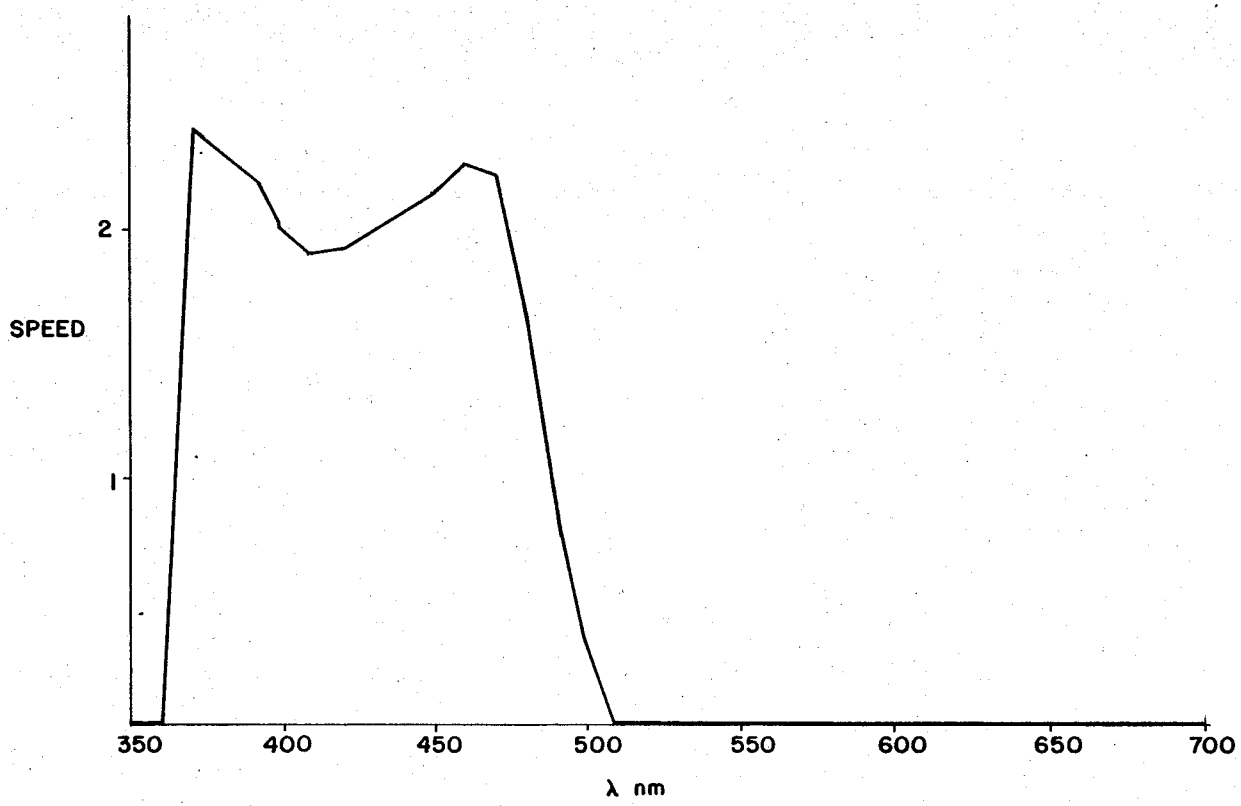

As noted above, neither the coating of dye crystals alone (Coating 3) nor the mixture of conventionally-precipitated AgCl with dye crystals (Coating 2) recorded any image under the experimental conditons of exposure and processing. The conventionally spectrally sensitized Coating 1 showed sensitivity through the blue region of the spectrum as indicated in FIG. 4, peaking at about 470 nm. Coating 4 of the invention showed sensitivity through the blue and violet, with a peak at about 450 nm characteristic of the dye absorption, and considerable sensitivity at lower wavelengths, which is considered dye-associated rather than intrinsic sensitivity. The silver halide-dye association obtained by growing the silver halide on the dye crystals has thus led to spectral sensitization of the silver halide which could not be achieved by mixing preformed silver halide with dye crystals. A strong spectral sensitization was also obtained with the more concentrated emulsion Coating 5. The sensitivity curve of FIG. 6 showed a marked peak at about 460 nm, characteristic of the dye absorption.

EXAMPLE 2

This example demonstrates the preparation of a nonaqueous silver halide emulsion according to the invention.

Into a reaction vessel were introduced 1 mmole of Dye I dispersed in 250 cc of ethyl acetate. By double jet addition while stirring the contents of the reaction vessel a silver salt in the form of $CF_3COOAg$, 17 grams/400 cc ethyl acetate, 0.20 molar, and a halide salt in the form of $[CH_3(CH_2)_3]_4NCl$, 22 gms/400 cc ethyl acetate, 0.20 molar, were separately and concurrently run into the reaction vessel each at a rate of 10 cc/min for 10 minutes. This resulted in 0.02 mole of AgCl being precipitated with 50 mmoles of Dye I being present per mole of Ag.

Electron micrographs were made of the dye crystals prior to silver halide deposition. Microscopic examination of the dye crystals after silver chloride precipitation showed the silver chloride grains to be located on the dye crystals.

The dye crystals appeared yellow while the silver chloride appeared as dark brown masses on the dye crystals, the dark appearance of the silver chloride being attributed to printout prouced by microscope illumination.

The invention has been described in detail with particular reference to preferred embodiments thereof, but it will be understood that variations and modifications can be effected within the spirit and scope of the invention.

What is claimed is:

1. A photographic emulsion comprising
grains containing a silver salt capable of forming a latent image,
a sensitizing dye, and
a dispersing medium,
characterized in that
said sensitizing dye is present in the form of host crystals and
said grains are in conductive contact with said host dye crystals.

2. A photographic emulsion according to claim 1, wherein said dispersing medium is a hydrophilic colloid.

3. A photographic emulsion according to claim 1, wherein said silver salt is silver halide.

4. A photographic emulsion according to claim 3, wherein said silver halide is comprised of silver chloride.

5. A photographic emulsion according to claim 1 wherein said sensitizing dye is a methine dye.

6. A photographic emulsion according to claim 5 wherein said sensitizing dye is a cyanine or merocyanine dye.

7. A photogrphic element containing an emulsion according to any one of claims 1 through 6.

8. A photographic element comprising
a film support and, coated on said film support,
at least one photographic emulsion comprising grains containing a silver salt capable of forming a latent image, a sensitizing dye, and a dispersing medium,
characterized in that
said sensitizing dye is present in the form of host crystals and
said grains are in conductive contact with said host dye crystals.

9. A photographic element according to claim 8, wherein said photographic element contains blue, green, and red recording emulsion layers and said one emulsion is a blue recording emulsion layer.

10. A photographic element according to claim 8, wherein said photographic element contains blue, green, and red recording emulsion layers and said one emulsion is a green recording emulsion layer.

11. A photographic element according to claim 8, wherein said photographic element contains blue, green, and red recording emulsion layers and said one emulsion is a red recording emulsion layer.

12. A radiographic element comprising
a support having first and second major faces and, coated on each of said major faces,
a photographic emulsion comprising grains containing a silver salt capable of forming a latent image, a sensitizing dye, and a dispersing medium,
characterized in that
said sensitizing dye is present in the form of host crystals and
said grains are in conductive contact with said host dye crystals.

* * * * *